US011006762B2

(12) United States Patent
Stewart, Jr.

(10) Patent No.: US 11,006,762 B2
(45) **Date of Patent: *May 18, 2021**

(54) COMPRESSIBLE FOAM FOUNDATION FOR MATTRESS SUPPORT

(71) Applicant: James O. Stewart, Jr., Jackson, MO (US)

(72) Inventor: James O. Stewart, Jr., Jackson, MO (US)

(73) Assignee: Mattress Angel, LLC, Jackson, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/664,840

(22) Filed: Oct. 26, 2019

(65) Prior Publication Data

US 2020/0054147 A1 Feb. 20, 2020

Related U.S. Application Data

(63) Continuation-in-part of application No. PCT/US2018/029412, filed on Apr. 25, 2018, which (Continued)

(51) Int. Cl.
*A47C 19/12* (2006.01)
*A47C 23/00* (2006.01)

(Continued)

(52) U.S. Cl.
CPC ..... *A47C 19/12* (2013.01); *A47C 19/025* (2013.01); *A47C 23/005* (2013.01); *A47C 27/16* (2013.01); *A47C 31/001* (2013.01)

(58) Field of Classification Search
CPC ..... A47C 27/14; A47C 27/142; A47C 27/146; A47C 27/16; A47C 19/12; A47C 19/025; A47C 31/001
See application file for complete search history.

(56) References Cited

U.S. PATENT DOCUMENTS 2,878,494 A * 3/1959 Healy ..... A47C 27/16 5/722
3,268,922 A * 8/1966 Moxley ..... A47C 27/14 5/420

(Continued)

FOREIGN PATENT DOCUMENTS

DE 202011052257 U1 1/2012

OTHER PUBLICATIONS

English Translation of DE202011052257U1, provided in International Search Report for PCT/US18/29412 dated Jul. 20, 2018.

(Continued)

*Primary Examiner* — Eric J Kurilla
(74) *Attorney, Agent, or Firm* — Creativenture Law, LLC; Dennis Jm Donahue, III; Kevin C. Staed

(57) ABSTRACT

A foundation for a mattress is formed from one or more single-layer, unitary foam blocks with supports that extend across each foam block's bottom side. The supports provide crosswise support across a bed frame and can be directly attached to the foam block or may be provided in a kit or separately sourced. The foam block is rigid enough to support a mattress and is compressible so it has a compressed configuration and an expanded configuration, and its bottom side may have channels for the supports. In the compressed configuration, the foundation may be folded and vacuum-sealed in a plastic membrane which provides benefits for storing, shipping, and delivering the foundation. When the foundation is delivered to its place of use, the compressed foundation is removed from its packaging, allowing the foam block to return to its expanded configuration.

20 Claims, 7 Drawing Sheets

Related U.S. Application Data is a continuation-in-part of application No. 15/499,077, filed on Apr. 27, 2017, now Pat. No. 9,756,951, and a continuation-in-part of application No. 15/694,057, filed on Sep. 1, 2017, now Pat. No. 10,165,865, which is a continuation of application No. 15/499,077, filed on Apr. 27, 2017, now Pat. No. 9,756,951.

(60) Provisional application No. 62/415,534, filed on Nov. 1, 2016.

(51) Int. Cl.

| | |
|---|---|
| ***A47C 19/02*** | (2006.01) |
| ***A47C 31/00*** | (2006.01) |
| ***A47C 27/16*** | (2006.01) |

(56) References Cited

U.S. PATENT DOCUMENTS

| | | | | | |
|---|---|---|---|---|---|
| 3,370,306 | A | * | 2/1968 | Lovette | A47C 21/06 5/659 |
| 3,513,491 | A | | 5/1970 | Gordon | |
| 3,872,525 | A | * | 3/1975 | Lea | A47C 27/084 5/671 |
| 3,973,281 | A | | 8/1976 | Davis | |
| 4,025,974 | A | | 5/1977 | Lea | |
| 4,106,139 | A | | 8/1978 | Southard | |
| 4,134,166 | A | | 1/1979 | Schuder | |
| 4,181,991 | A | | 1/1980 | Morgan | |
| 4,389,961 | A | * | 6/1983 | Parish | A47C 27/084 114/345 |
| 4,711,067 | A | | 12/1987 | Magni | |
| 4,928,337 | A | * | 5/1990 | Chauncey | A47C 27/001 5/722 |
| 5,111,542 | A | * | 5/1992 | Farley | A47C 27/148 5/727 |
| 5,231,714 | A | | 8/1993 | Mossbeck | |
| 5,469,589 | A | | 11/1995 | Steed | |
| 5,524,307 | A | | 6/1996 | Griffin | |
| 5,533,218 | A | * | 7/1996 | Fahy | A47C 27/144 5/421 |
| 5,681,090 | A | | 10/1997 | St. Thomas | |
| 5,701,653 | A | | 12/1997 | Rupe | |
| 5,983,423 | A | | 11/1999 | Rupe | |
| 6,061,856 | A | | 5/2000 | Hoffmann | |
| 6,098,378 | A | | 8/2000 | Wyatt | |
| 6,662,393 | B2 | | 12/2003 | Boyd | |
| 6,832,397 | B2 | | 12/2004 | Gaboury | |
| 6,901,722 | B2 | | 6/2005 | Dextraze | |
| 7,293,311 | B2 | | 11/2007 | Baker | |
| 7,334,280 | B1 | | 2/2008 | Swartzburg | |
| 8,158,249 | B2 | | 4/2012 | Greer | |
| 8,250,689 | B2 | | 8/2012 | Gladney | |
| 8,347,588 | B2 | | 1/2013 | Oh | |
| 8,443,974 | B2 | | 5/2013 | Oh | |
| 8,528,132 | B2 | | 9/2013 | De Bock | |
| 8,990,979 | B1 | | 3/2015 | Craver | |
| 9,259,099 | B1 | | 2/2016 | Larsen | |
| 9,655,456 | B2 | * | 5/2017 | Boyd | A47C 27/085 |
| 2002/0148045 | A1 | * | 10/2002 | Giori | A47C 27/088 5/709 |
| 2003/0009830 | A1 | * | 1/2003 | Giori | A47C 27/084 5/709 |
| 2004/0055086 | A1 | | 3/2004 | Owens, Jr. | |
| 2004/0074007 | A1 | * | 4/2004 | Gladney | A47C 23/04 5/727 |
| 2005/0000026 | A1 | | 1/2005 | Gladney | |
| 2006/0075569 | A1 | * | 4/2006 | Giori | A47C 27/088 5/709 |
| 2006/0123551 | A1 | * | 6/2006 | Hsia | A47C 23/06 5/706 |
| 2008/0235868 | A1 | | 10/2008 | Snitzer | |
| 2008/0263772 | A1 | * | 10/2008 | Chiu | A47C 4/54 5/654 |
| 2009/0144903 | A1 | | 6/2009 | Delvaux | |
| 2010/0146706 | A1 | | 6/2010 | Siegner | |
| 2013/0145555 | A1 | * | 6/2013 | Hargreaves | A47C 27/15 5/655 |
| 2014/0059769 | A1 | | 3/2014 | Baker | |
| 2015/0015402 | A1 | | 1/2015 | Boyd | |
| 2016/0000231 | A1 | * | 1/2016 | Auell | A47C 27/15 5/420 |
| 2016/0088951 | A1 | | 3/2016 | McGuinness | |
| 2016/0304231 | A1 | | 10/2016 | Corodemus | |

OTHER PUBLICATIONS

International Search Report for PCT/US18/29412, dated Jul. 20, 2018.

* cited by examiner

COMPRESSIBLE FOAM FOUNDATION FOR MATTRESS SUPPORT

CROSS-REFERENCE TO RELATED APPLICATIONS

This application is a continuation-in-part of International Application No. PCT/US18/29412 filed on Apr. 25, 2018, designating the United States and claiming priority to U.S. patent application Ser. Nos. 15/499,077 and 15/694,057 filed on Apr. 27, 2017 and Sep. 1, 2017 and issued on Sep. 12, 2017 and Jan. 1, 2019 as U.S. Pat. Nos. 9,756,951 and 10,165,865, respectively, the former claiming priority to Provisional Application. No. 62/415,534 filed on Nov. 1, 2016, all of which are hereby incorporated by reference.

STATEMENT REGARDING FEDERALLY SPONSORED RESEARCH

Not Applicable.

APPENDIX

Not Applicable.

BACKGROUND OF THE INVENTION

Field of the Invention

The present invention relates to foundations for mattresses, and more particularly to foundations made of foam that may be compressed and folded into dimensions more suitable for shipping and storage.

Related Art

Prior art mattress foundations have typically been produced using hard materials like wood and plastic which must be assembled before they are able to support a mattress. These known mattress foundations typically consist of a rectangular frame with a series of slats spanning the width of the rigid frame so that the foundation frame sits on and spans a standard bed frame and a mattress is supported by the slats on the top side of the foundation. Other types of known foundations substitute the series of slats for one or more cross beams or a single panel of rigid material which may be known as a platform mattress foundation. Additionally, some known mattress foundations combine the rigid frame and cross members with supporting springs and are known as "box springs." These box springs are designed to provide more ergonomic support as they may flex when certain amounts of force are applied to the supported mattress, but the rigidity of the frame and stiffness of the springs still prevent folding and compression that equates to the compactness of the compressible foam mattress foundation described herein. Some of these mattress foundations with rigid support members can be disassembled for storage, shipment, and delivery, but these rigid foundations must then be assembled for use.

Some current mattress foundations include foam as a primary support material for the mattress rather than the rectangular frame with slats as described above. However, these foam foundation assemblies include a rigid panel base that spans the entire area within the periphery of the foam block (lengthwise and crosswise). For example, U.S. Pat. No. 4,106,139 discloses a foam foundation, but the panel base connected to the foundation within the cover is rigid and prevents the foundation from being folded for easier shipping and storage. As seen in US Pat. Pub. No. 2004/0055086, separate foam foundation modules have individual panel bases that are connected together by hinged fasteners that allow the modules to be folded. Although adjacent panel bases are connected together by fasteners, foam blocks in adjacent modules are not connected in order to permit the modules' adjacent panel bases to be folded together at the hinged fasteners without folding the foam blocks. The folded foundation modules can be stored, shipped, and delivered and then unfolded when ready for use. The folding of the modules reduces the length of the packaged foundation which helps in the delivery of each foundation but does not necessarily reduce the volume of space it takes for storing and shipping a large group of foundations.

Although the foldable foam-panel modules disclosed by the '086 Application may have an advantage over the unfoldable foam-panel structure disclosed by the '139 Patent by helping in the delivery of foam foundations, it also introduces discontinuities in the support of the mattress because of the multiple sections of foam. None of the prior art references consider using a single, unitary foam block for a foundation with multiple separate support beams that are not directly connected to each other but are only connected to each other through their attachment to the unitary foam block. Prior to the present invention, the conventional thoughts in the bedding industry had been that panels should cover the entire surface area within the periphery of the foam block to properly support the foam block and avoid sagging due to lack of some rigid support across the entire lengthwise and crosswise dimensions of the panel. Even in the '139 Patent which has a corrugated bottom surface with grooves in the surface which do not contact the panel, the panel or some other structural support spans the entire surface area within the foam block's periphery, lengthwise and crosswise, and provides rigidity to the foundation assembly in both the lengthwise and crosswise dimensions.

It has also been known to compress and fold foam mattresses so that they can be stored, shipped, and delivered in a compact form. However, prior to the present invention, the bedding industry has never been able to both compress and fold foam foundations to the same degree as foam mattresses because the rigid panels or outer rigid framework with interior slats that have traditionally been used for foam foundations had required the rigidity in both the lengthwise and the crosswise dimensions. There has remained a need for a foam foundation that could be folded and compressed to be stored, shipped, and delivered in a compact form and then unfolded and expanded into a usable configuration that provides support to the mattress and has sufficient rigidity spanning the bed frame in either a lengthwise or crosswise dimension to avoid sagging. It would be beneficial to have a compressible foam foundation that does not require a lengthwise and crosswise rigid frame or panels beneath the foam block, or does not require a frame that must be assembled before the foundation can be used to support a mattress on a bed frame.

BRIEF DESCRIPTION OF THE DRAWINGS

The present invention will become more fully understood from the detailed description and the accompanying drawings, wherein FIGS. 1-5 generally illustrate the invention as particularly described below.

DETAILED DESCRIPTION OF THE PREFERRED EMBODIMENTS

Figure 1A:
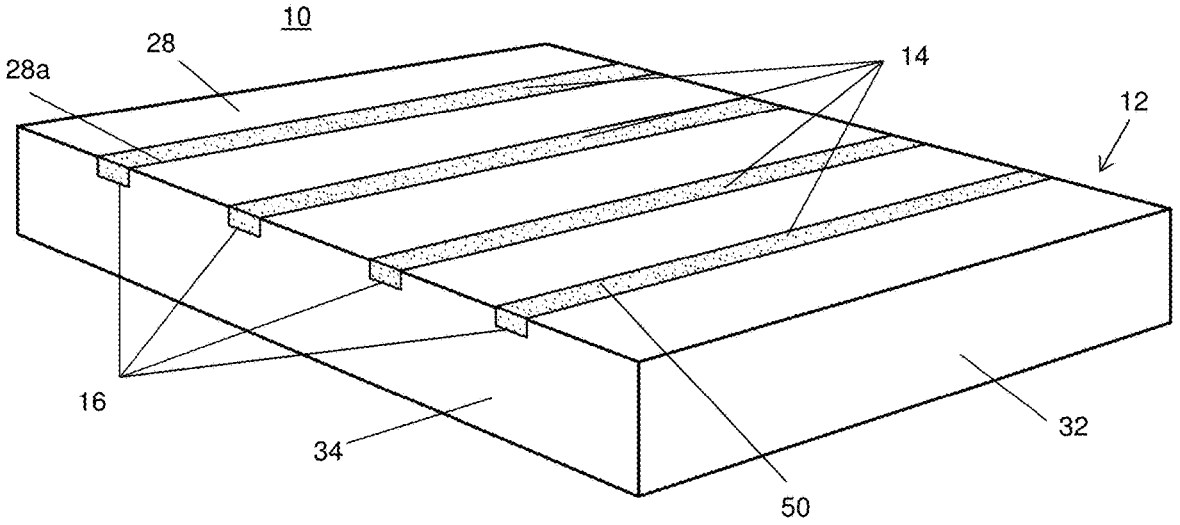
FIG. 1A shows a bottom view of an uncovered foam foundation for a mattress with crosswise supports.

The following description of the preferred embodiment(s) is merely exemplary in nature and is in no way intended to limit the invention, its application, or uses.

A foundation 10 for a mattress made up of a foam block 12 that is preferably a single layer of a unitary foam block that has an internally homogenous structure, i.e., without any internal elongated chamber, space, or other large void within the center portion of the foam block, and that preferably includes a plurality of rigid crosswise supports 14 at the bottom side of the foam block. The foam block is made of a compressible and flexible firm foam 72 having a density of 0.85-5.0 pounds per cubic foot and having an indentation force deflection ("IFD") between thirty-nine and ninety-five (39-95 IFD) which has sufficient firmness and strength to support a mattress but is not rigid so that the foam block may still be compressed and is flexible enough to bend both laterally and longitudinally. The foam is preferably polyurethane or any other firm foam that both compressible and flexible. A lower range IFD of 30-39 would be possible for a lighter weight product but would likely have limited applications, such as for small children or infants.

The foam block has an expanded configuration 42 in which the foam block reaches its full thickness 44*b* and a compressed configuration 40 in which the foam block is pressed down to a reduced thickness 44*a*. The reduced thickness is less than half of the expanded thickness and is preferably between 15% and 25% of the expanded thickness. In the expanded configuration, the foam block supports a mattress and may be produced to the length and width dimensions that accommodate mattresses of various sizes. Typically, these dimensions will conform to traditional mattress and mattress foundation sizes, namely twin, full, queen, king, California king, etc. which typically have a length between seventy-four (74) and eighty (80) inches (74"-80"). However, traditional bedding sizes are not intended to be limiting, and the foundation size may vary in dimension relative to the mattress intended to be supported, including custom dimensions not traditionally used in the bedding industry.

Typically, foundations have a low profile thickness between five and eight inches (5"-8") or a high profile thickness between nine and twelve inches (9"-12") when expanded to their full thickness. When the foam block is compressed, the reduced thickness is approximately between two and three inches (2"-3"). It will be appreciated that the reduced thickness is primarily dependent on the full thickness of the foam block, but the IFD of the foam could also play a factor in the amount to which the foam can be compressed, particularly depending on the equipment that is used to compress the foam. The compression of the foam block is primarily unidirectional so that the compressed configuration and the expanded configuration have nearly the same lateral width 36 between the pair of foundation sides 34 and longitudinal foundation length 38 between the head side 30 and the foot side 32. The foam's IFD is measured using an industry standard technique, such as ASTM D3574 entitled "Standard Test Methods for Flexible Cellular Materials—Slab, Bonded, and Molded Urethane Foams" and published by ASTM International, and the measurement technique for the foam's IFD does not form a part of the present invention.

Another aspect of the foam foundation are the crosswise supports connected to the foam block's bottom side 28. These crosswise rigid supports 14 act as a skeletal structure and provide rigid structure to the foam foundation 10, but the supports are thin enough (less than 2" or 3") to allow the foundation to be compressed to its reduced thickness, and there is no rigid connection between the crosswise supports so that the flexible foam block can be rolled with the rigid supports into the preferred shipping arrangement. Preferably, the crosswise supports in a unitary foam block are only connected to each other through their attachment to the unitary foam block and not through any other structure. The crosswise supports preferably extend laterally across the foam block so that the foam block rolls in the longitudinal direction around the foam block's lateral axis which results in the most compact configuration of the compressed and rolled foam foundation. The crosswise rigid supports may be any number of shapes including but not limited to beams, slats, rods, and planar panels. Additionally, the crosswise supports may be made from any number of rigid materials including but not limited to woods, plastics, metals, hardened foams, composites, and other similar materials. The crosswise supports preferably traverse the entire width of the foundation and are substantially perpendicular to the side edges while remaining substantially parallel to one another. The crosswise supports extend between the sides of the foundation so that they can be placed onto a standard bed frame and provide even support across the span of the bed frame. Preferably, the crosswise supports are connected to the foam block during manufacture prior to shipping, but the foam foundation and crosswise supports can alternatively be shipped together in an unattached arrangement. In another alternative arrangement, foam foundation can be shipped on its own, and a user may provide their own crosswise supports for connection to the foam foundation.

It is generally an aspect of the foam foundation to have crosswise supports spaced apart from each other by a distance 46. The crosswise supports provide crosswise rigidity to the foundation and are flexibly connected to each other through contiguous portions of the single flexible foam block that extend between adjacent crosswise supports; they are not rigidly connected. The spaced distance 46 will vary based on the number of crosswise supports included in the foundation and its size and the shape of the crosswise supports. In spacing the crosswise supports from each other, the distance separating the supports has a range that is greater than the reduced thickness 44*a* of the foam block 12, preferably greater than the foam block's full thickness 44*b*, and less than the foam block's lateral width 36. Increasing the distance reduces the number of crosswise supports which reduces the cost of the foundation and the weight of the foundation. The maximum distance depends on the expanded foam block's strength and firmness and preferably prevents the foam block from sagging between the rigid crosswise supports. The minimum distance depends on the flexibility of the foam, particularly in the compressed configuration and preferably allows the foam block's compressed configuration to be folded. The distance between the crosswise supports should not be increased so much that it results in sagging which could negatively impact the uniform, firm support that is provided to the mattress above the foundation. The distance between the crosswise supports can vary to avoid sagging at the ends of the foundation, such as with the crosswise supports adjacent to the head side and foot side of the foam block being spaced closer to the ends. Preferably, the distance between adjacent crosswise supports in the center section of the foundation is approximately 14.5" and can be as far as 20".

Figure 1B:
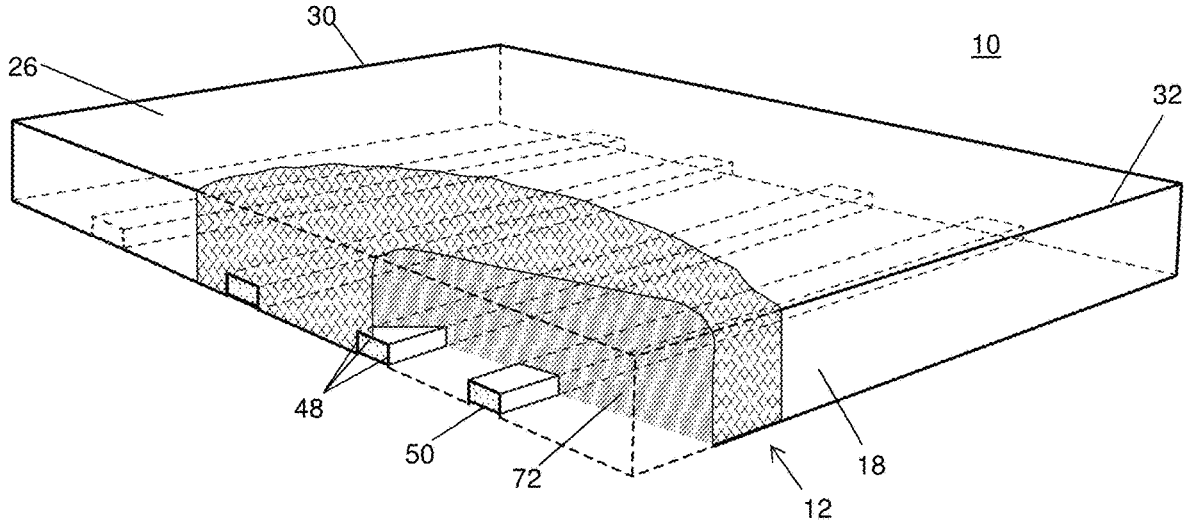
FIG. 1B shows a partial cutaway top view of a foam foundation for a mattress with crosswise supports and a cover.

As shown in FIGS. 1A and 1B, the foam block preferably has channels 16 recessed into its bottom side, and the crosswise supports fit into the channels. The channels can be cut into the bottom side of the foam block or formed into the foam block's bottom side, and in either case, the channels extend the entire width of the foam block between the sides. Additionally, the channels are spaced apart at locations corresponding with the distance between the crosswise supports. Preferably, the dimensions of the crosswise support are substantially equivalent to the channels' dimensions such that the length, width and thickness of the supports are equal to or slightly larger than the channel length, channel width, and channel depth. Accordingly, the crosswise supports can be friction fit 68 within the channels or can be fixed within the channels with an adhesive 66 as the crosswise supports have sides 48 that contact the walls of the channel. The crosswise supports are preferably rectangular or square with four (4) sides, and three (3) of the sides are in contact with the walls of the channels while the fourth outer-facing side 50 is not in contact with any of the channels' walls. It will be appreciated that different shaped crosswise supports may be used, including but not limited to circular supports or triangular supports, but the outer-facing sides are preferably flush with the foam foundation's bottom surface 28*a* when in the expanded configuration.

According to the embodiment shown in FIG. 2, the foam foundation 10 does not have channels 16 recessed into its bottom side 28, and narrow crosswise supports 14 can be connected directly to the foundation's bottom surface 28*a* with an adhesive 66. In this embodiment, the crosswise supports are preferably planar in shape and are attached to the bottom surface of the foam foundation along a single side. It will be appreciated that supports having a non-planar shape can also be used. Accordingly, the crosswise supports in this embodiment may not be substantially flush with the bottom surface of the foam foundation. The foam foundation and crosswise supports may be attached during manufacture, shipped as a kit, or assembled from separately sourced parts.

Figure 2A:
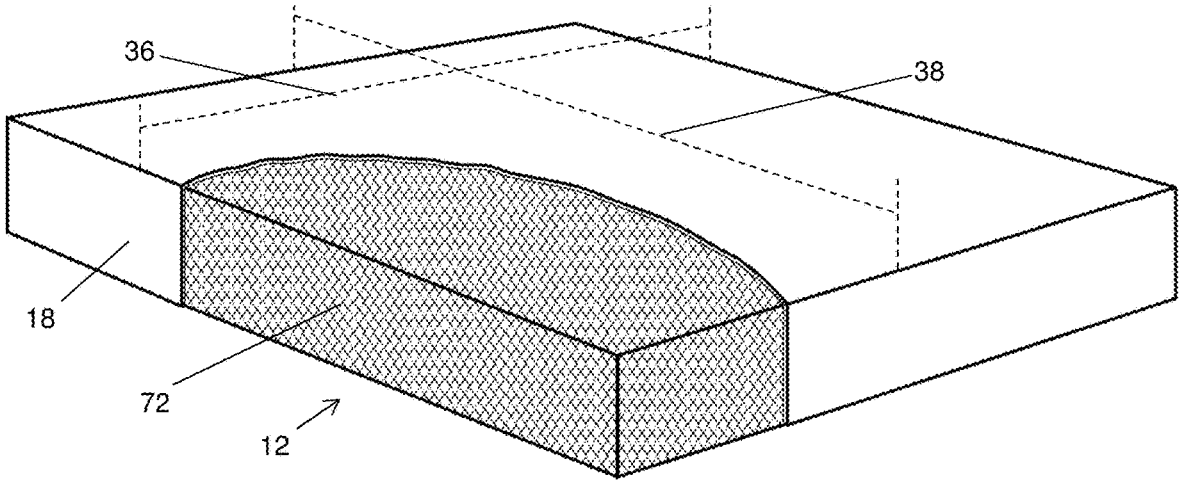
FIG. 2A shows a partial cutaway top view of a covered foam foundation for a mattress without crosswise supports.
Figure 2B:
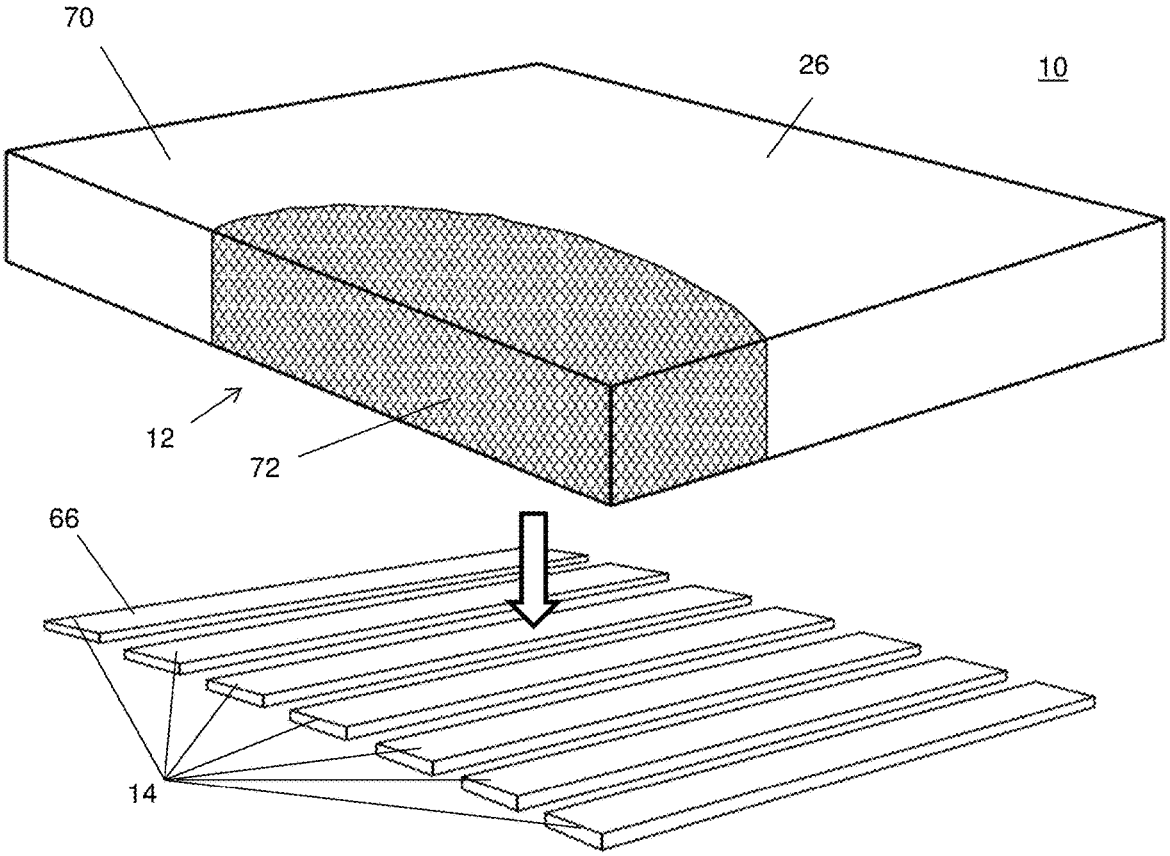
FIG. 2B shows a partial cutaway top exploded view of a foam foundation for a mattress with crosswise supports and a cover.

In another aspect of the present invention, a cover 18 envelops the foam block 12 as shown in FIGS. 1B, 2A, and 2B and also preferably envelops the crosswise supports 14 as shown in FIG. 1B. In yet another aspect of the present invention, the compressed configuration of the foam foundation 10 is encased by a plastic membrane 20 as shown in FIG. 3C. Accordingly, the foam block, cover and plastic membrane collectively form the packaged foundation assembly 58 discussed below. The cover is preferably removable to allow easy washing and replacement, but it may alternatively be permanently sewn over the foam block and crosswise supports. Different fasteners can be used to secure a removable cover around the foundation, including but not limited to zippers, hook and loop fasteners, snaps, buttons, and other similar closing and securing means. The cover is preferably made from a flame retardant material 70 or a material or combination of materials that pass or exceed the Federal Law 16 C.F.R. 1633 flammability standard to help make the foam foundation flame retardant.

Figure 3A:
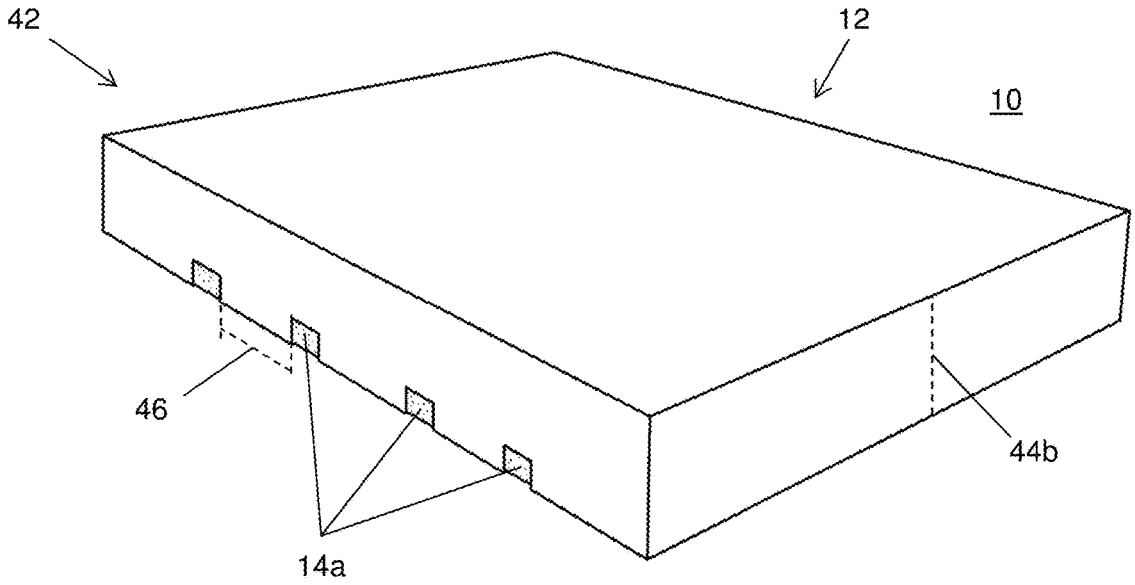
FIG. 3A shows a foam foundation for a mattress in the expanded configuration.
Figure 3B:
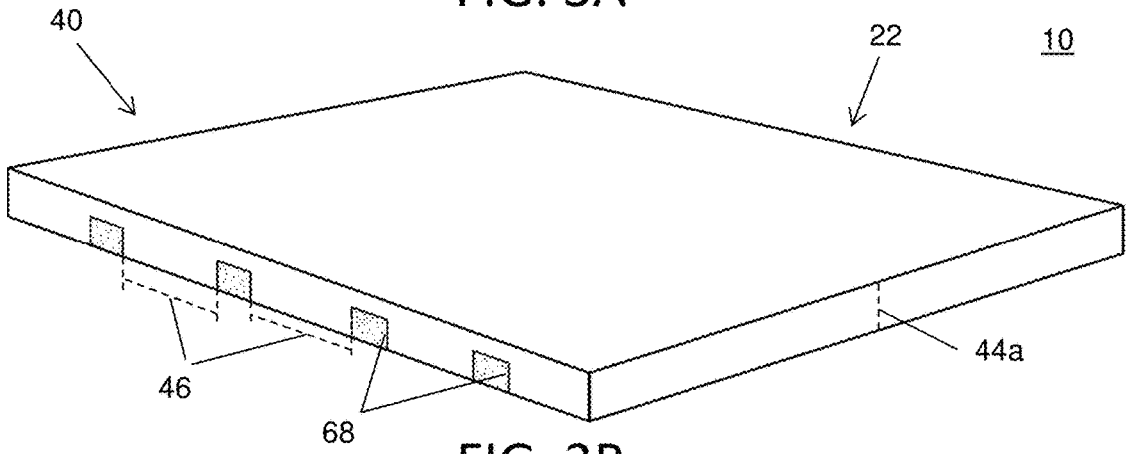
FIG. 3B shows a foam foundation for a mattress in the compressed configuration.
Figure 3C:
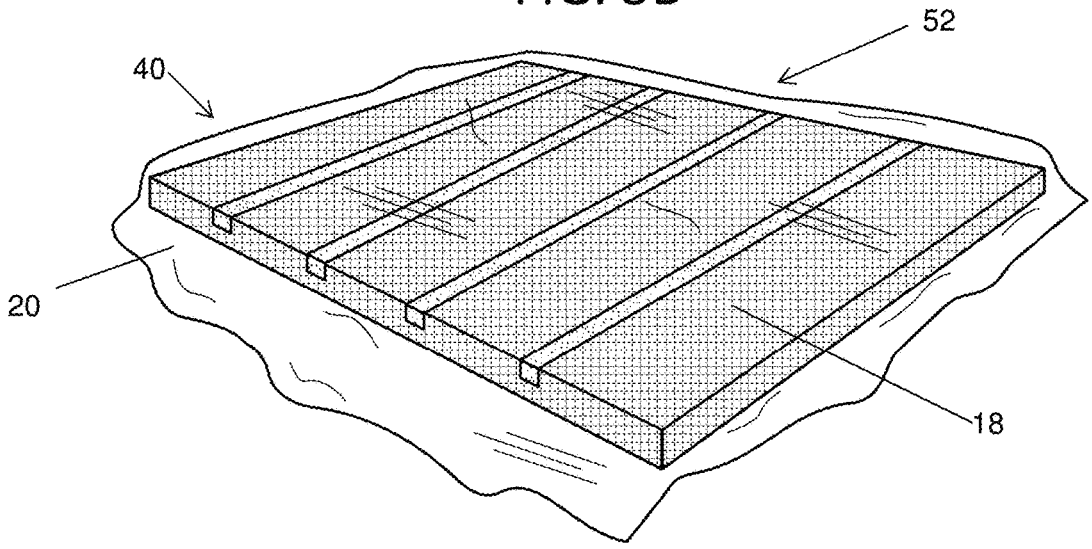
FIG. 3C shows a foam foundation for a mattress in the compressed configuration encased in a plastic membrane.
Figure 4A:
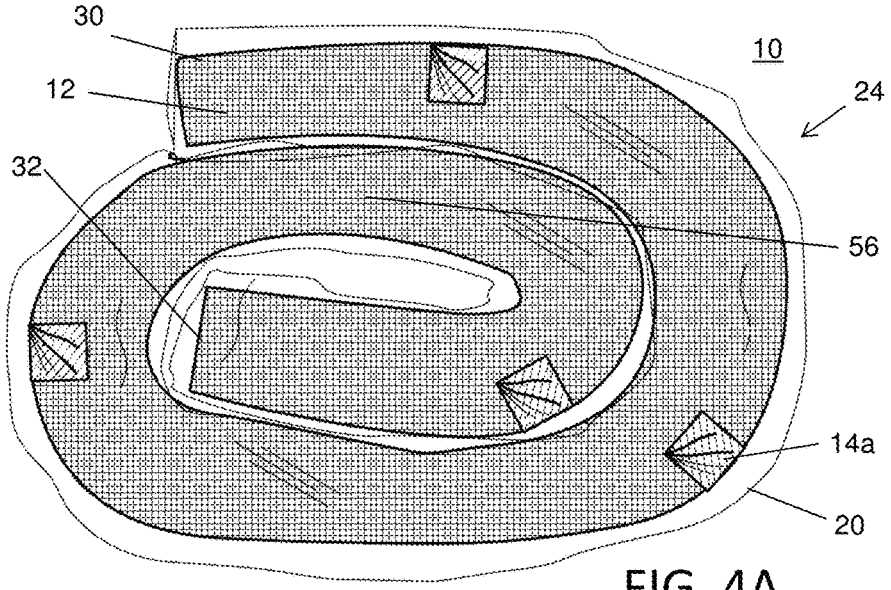
FIG. 4A shows a foam foundation for a mattress in a compact forms.

Prior to compressing the foam block as shown in FIG. 3A, the plastic membrane 20 can be placed over the foundation, and once the foam block is in the compressed configuration 40 as shown in FIG. 3B, a vacuum can be drawn and the plastic membrane can be sealed. The vacuum seal can help sustain the compressed configuration as the flexible foam block bends as it is rolled into a coil shape or otherwise wrapped or folded and packaged for storage, shipment, and delivery. Collectively, the foam block 12, preferably with the crosswise supports 14, the cover 18, and the plastic membrane 20 form a packaged foundation assembly 58. It will be appreciated that the foam foundation and packaged foundation assembly has an opened arrangement 22 and a folded arrangement 24. In the opened arrangement, the compressed packed foundation assembly has a planar form 52 as depicted in FIGS. 1-3. In the folded arrangement, the flexible foam material bends between the rigid crosswise supports, and the foam block's head side and the foot side overlap its center section 56 as shown in FIG. 4A. When folded, the packaged foundation assembly is in a compact form 54 and is secured by shipping material 60 for optimized storage, shipping and easier delivery, especially through constriction points, such as doors, stairwells, or vehicle cargo space.

Figure 4B:
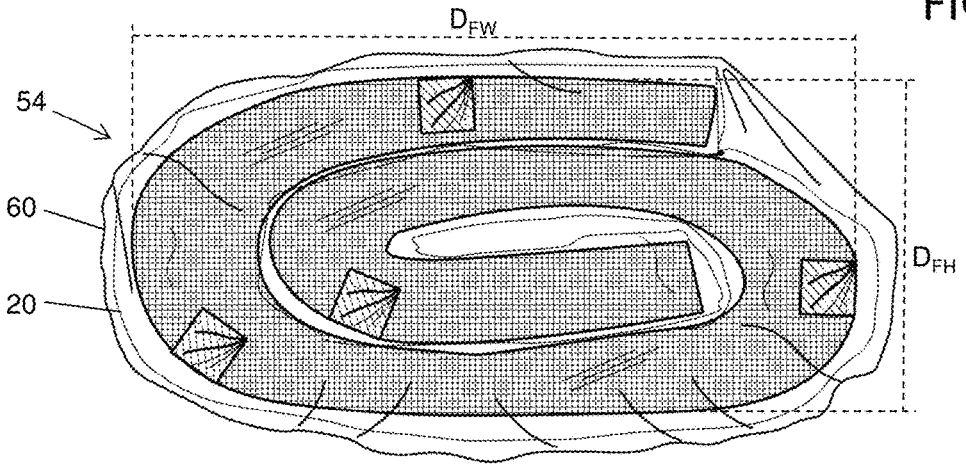
FIGS. 4B and 4C show a foam foundation for a mattress in a compact form placed in a shipping material, a plastic bag and carton respectively.

The crosswise supports maintain the rigidity of the foam foundation in the direction of the supports' axes so that the foundation can only fold around the supports' crosswise axes. Depending on the number of crosswise supports and the flexibility of the foam, the number of overlapping sections in the folds can vary. Generally, the packaged foundation assembly in its compact form has a folded height and a folded width that fit within boxes with the longest dimension being slightly larger than the width of the foam block between its sides and the other dimensions being less than half of this longest dimension. As shown in FIG. 4B, a foam foundation, compressed from its full thickness between nine and twelve inches (9"-12") down to a reduced thickness between two and three inches (2"-3"), has a compact form with a folded height $D_{FH}$ of approximately ten inches (10") which is less than twice the thickness of the full thickness of the uncompressed foam block and a folded width $D_{FW}$ of approximately twenty inches (20") which is less than the lateral width of the foam block. The foam foundation is held in its compact form and made ready to be packaged for shipment using shipping material 60 which can be any of several appropriate wraps or other binding shipping materials, such as stretch-wrapped plastic, shrink-wrapped plastic, preformed plastic bags, straps, or twine.

Figure 4C:
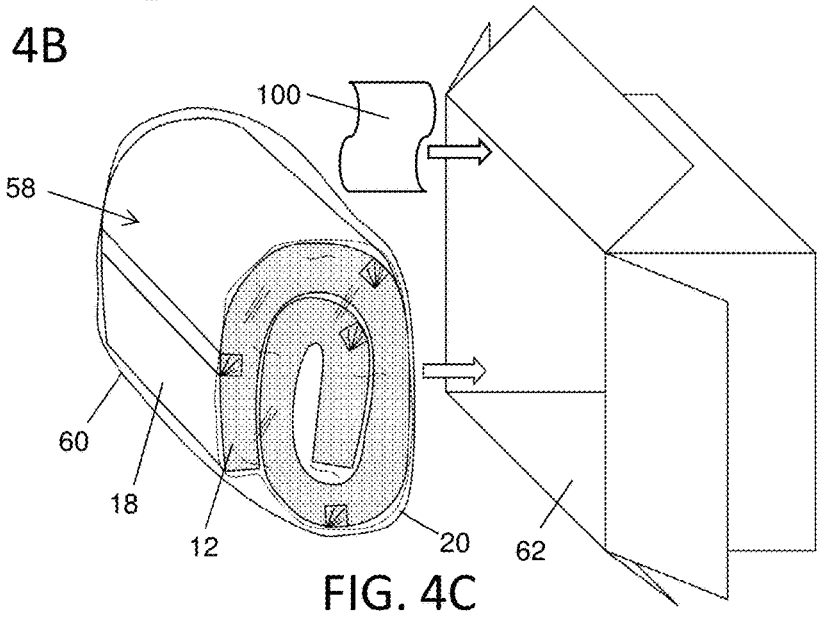

The packaged foundation assembly is preferably placed in a shipping container 62, such as a cardboard box, for shipment. For example, as shown in FIG. 4C, the compressed and folded foam foundation in the pressure-sealed plastic can be placed into an outer plastic bag 60 and then packed in a heavy corrugated cardboard carton 62. The shipping material is preferably strong enough to keep the foundation in its compressed state in the event that the vacuum-seal breaks during shipping or while in storage.

Figure 5A:
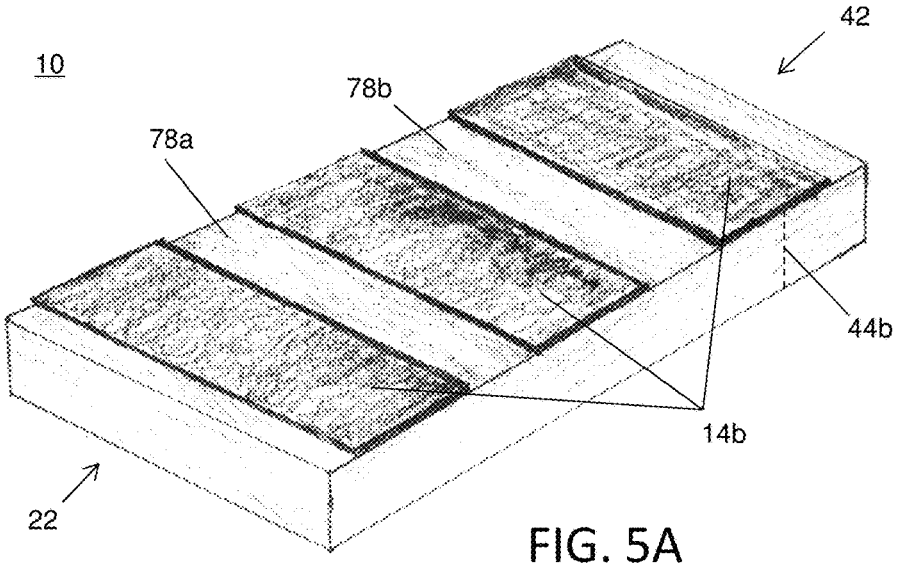
FIGS. 5A, 5B, 5C, and 5D show a foam foundation for a mattress with planar crosswise supports in an open expanded arrangement, an open compressed arrangement with a sealed plastic wrap, a folded arrangement with the plastic wrap, and the folded arrangement in a shipping bag, respectively.
Figure 5B:
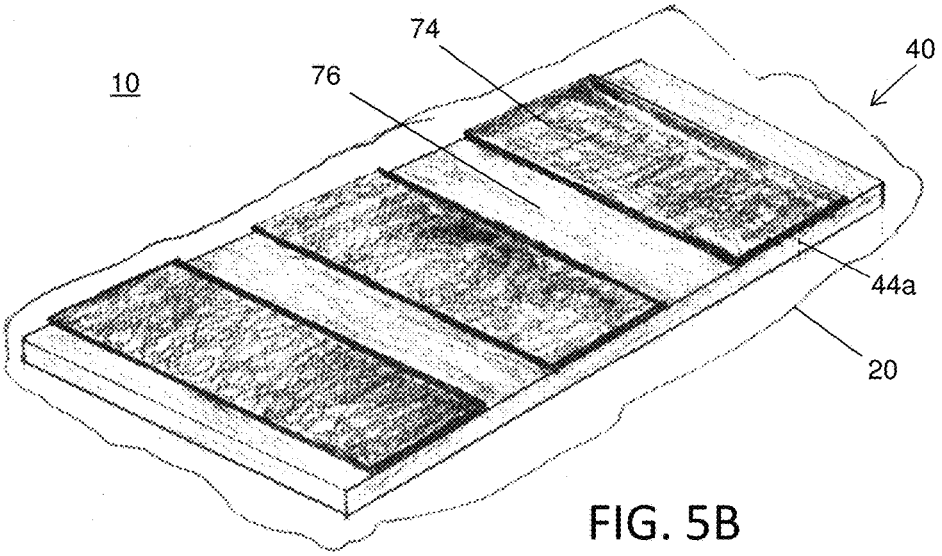

In the embodiments shown in FIGS. 1, 3, and 4, the crosswise supports are in the form of a beam support 14*a* which have a width that is less than the compressed thickness of the foam block and a thickness that is either the same as the width (i.e., a square support) or is no less than approximately one third of the beam's width. In the embodiments shown in FIGS. 2, 5, and 6, the crosswise supports are in the form of a panel support 14*b* that are wider than the compressed thickness of the foam block and are thin enough that no channel needs to be formed or cut into the foam, typically less than one quarter of the panel's width. In the embodiment shown in FIG. 5A, the crosswise supports are preferably adhered directly to the foam block. Each panel support 14*b* preferably is wider than the expanded thickness of the foam block with a supporting surface area 74 that is greater than the unsupported, exposed surface area 76 of the foam block, i.e., the supported area is greater than the unsupported area so the total panel surface area is more than half the total bottom side surface area of the foam block ($A_{Pl}>\frac{1}{2}*A_{Fb}$). The crosswise supports are preferably located proximate to the head region side, center body region and foot region side as shown in FIGS. 5A and 5B. It will also be appreciated that the number of panels may vary with more than one panel in each segment of foam, such as shown in FIG. 2B, in which case the panels are only connected to each other through their attachment to the unitary foam block and not through any other structure as with the single unitary foam block described above. Additionally, as with the thicker supports described above, it will be appreciated that the planar crosswise supports can be made from any rigid material, including plastic, metals, composites, and rigid foams.

Figure 5C:
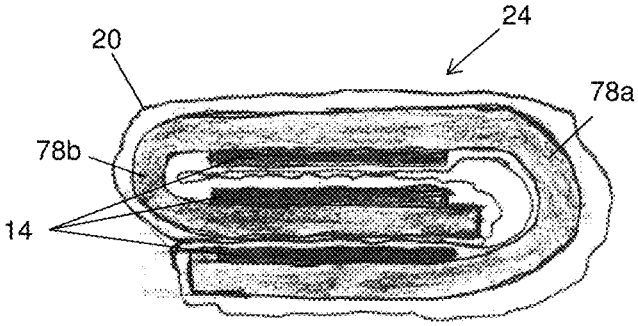
Figure 5D:
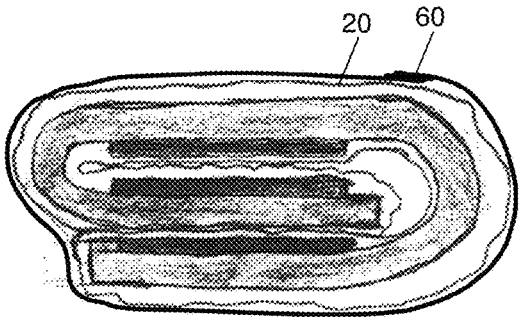

When the foundation shown in FIG. 5 having planar supports is compressed and arranged in the folded arrangement, the planar panels and respective foam sections overlap one another as depicted in FIG. 5C. Accordingly, there are gaps 78*a* and 78*b* between the planar panels allowing the foundation to be folded into the folded arrangement at the exposed region of the foam block. As with the embodiments described above, the folded foundation can be fit into a shipping bag, such as shown in FIG. 5D, and may be packaged for shipment, such as in a box as described above. Additionally, as with the embodiments described above, the distance separating the supports is preferably greater than the reduced thickness 44*a* of the foam block 12; to provide crosswise support across the span of the bed frame, the distance between the planar supports is preferably less than or equal to the foam block's full thickness 44*b* although it can be greater than this thickness for more sturdy foams with IFD values greater than 39.

Figure 6A:
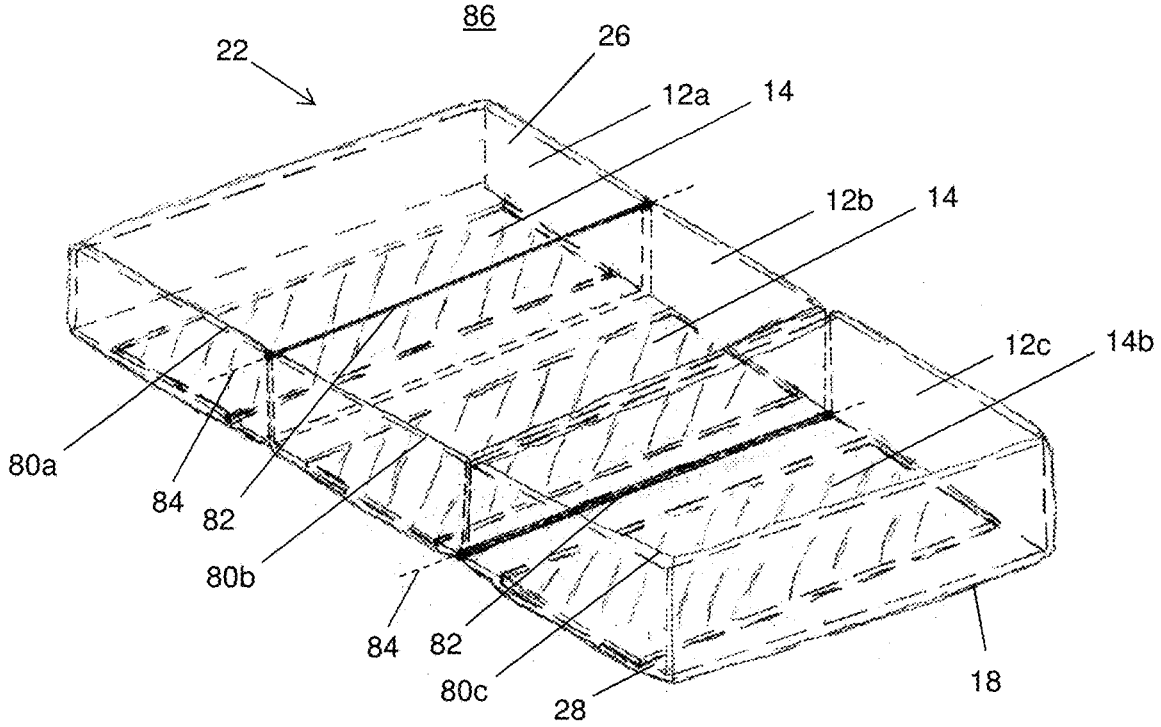
FIGS. 6A, 6B, and 6C show a segmented foam foundation for a mattress in an open arrangement, an uncompressed folded arrangement, a compressed folded arrangement, respectively.
Figure 6B:
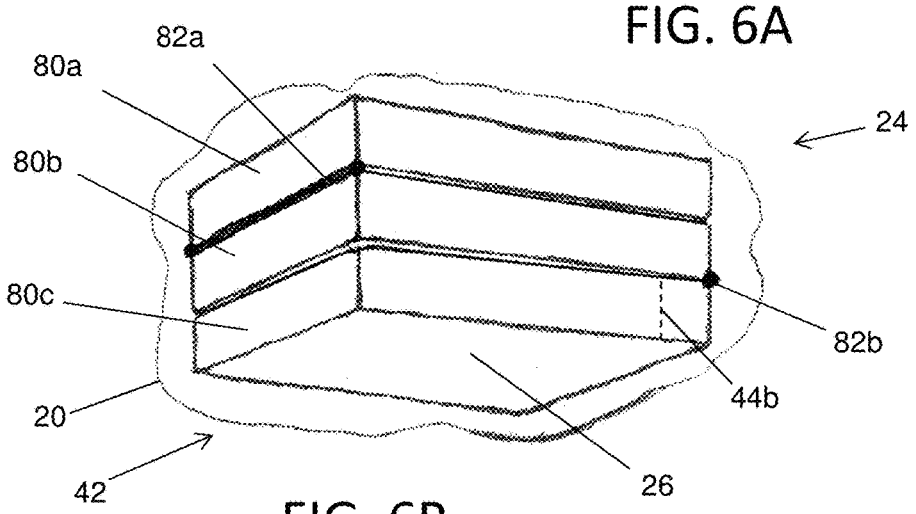
Figure 6C:
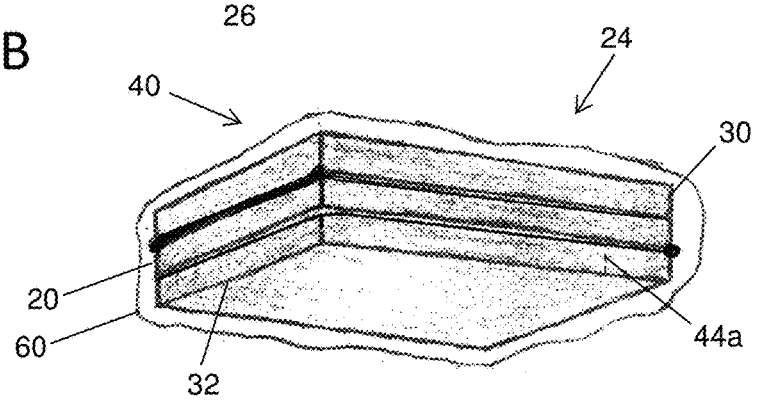

The segmented foam foundation 86 embodiment shown in FIG. 6 has multiple foam sections 12*a*, 12*b*, 12*c* that are connected by hinges 82 in the cover 18 and collectively make up a single-layer, segmented foam block. The segmented foundation preferably includes three (3) single-layer foam sections with a center section 80*b* between a head section 80*a* and a foot section 80*c*, as shown in FIG. 6A. As with the other embodiments described herein, crosswise supports are connected to the foam sections along the bottom side of the foundation. Preferably, the planar-type panel crosswise supports 14*b* are attached to corresponding foam sections 12*a*, 12*b*, 12*c*, respectively. It will be appreciated that thicker, non-planar crosswise beam supports may be used, and multiple supports may be connected to each foam section. As shown in FIG. 6A, one hinge 82 connects the head section to the center section on the top side 26 of the foundation and another hinge 82 connects the center section to the foot section on the bottom side 28 of the foundation, and the adjacent foam sections pivot about a hinge axis 84. The hinges are preferably formed with seams in the cover material and alternate between the top side and bottom side of the segmented foam foundation on opposite sides of each foam section which allows the foundation to be quickly rearranged between its unfolded arrangement and its folded arrangement, such as shown in FIGS. 6A and 6B. It will be appreciated that the foundation can be divided into more than three (3) segments with hinges that alternate between the top and bottom sides. As with the other embodiments described herein, the segmented foam foundation can also be encased in a vacuum-sealed plastic membrane 20 and compressed from its expanded configuration to its compressed configuration, such as shown in FIG. 6C.

In another aspect of the segmented foam foundation, the crosswise supports may cover the entire surface area of the corresponding foam sections and approximately abut one another in the opened arrangement. The adjacent crosswise supports may have a spacing greater than the reduced thickness of the foam block which helps in the rolling or folding of the foam block. However, with hinges in the cover at the interface between foam sections and alternating between the bottom side and the top side, no spacing or other gap between the crosswise supports is required in the segmented foam foundation embodiments other than whatever space is required for the cover that connects the adjacent foam sections.

Figure 7:
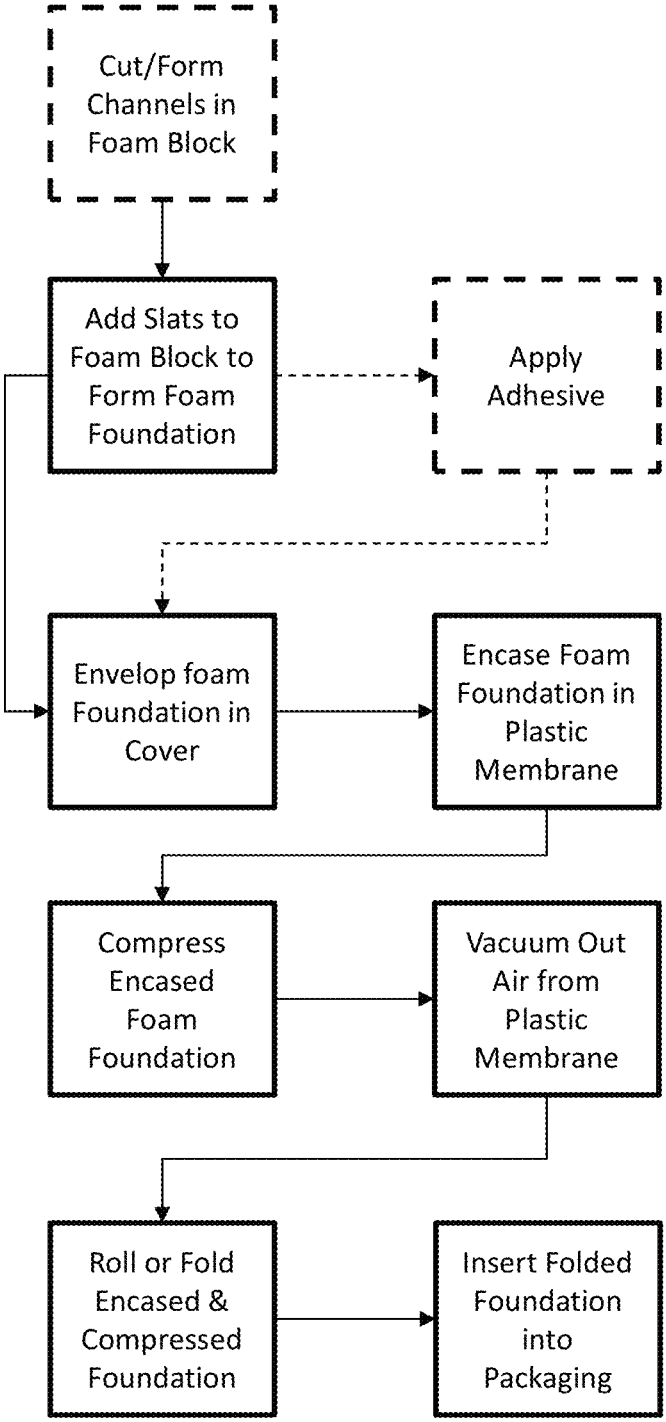
FIG. 7 illustrates steps in the method for producing a foam mattress foundation.

The present invention also provides for an inventive method for preparing a foam block for a mattress foundation as shown in FIG. 7 and according to the steps listed below.

a. Envelop the foam block with the cover while the foam block is in the expanded configuration.
b. Encase the foam block and the cover in the plastic membrane (which collectively form the packaged foundation).
c. Compress the foam block in the packaged foundation into its compressed configuration.
d. Vacuum-seal the plastic membrane.
e. Fold or roll the packaged foundation into its folded arrangement.
f. Pack the compressed and folded packaged foundation into a packing material and a shipping container for shipping and/or storage.

Generally, the above method describes how the foam foundation goes from the factory to the user with easier shipping, storage, and delivery in the compact form compared to the large and rigid prior art foundations. The vacuum-sealed plastic membrane, packing material, and shipping container are used to facilitate the shipping, storage, and delivery of the foam foundation. The compression of the foam may occur through any number of means, but pressure is preferably applied to the foundation while in the plastic membrane until the foam block reaches the desired compressed configuration. Once this compressed configuration is achieved, the plastic membrane is vacuum sealed and the pressure is removed.

The compressed vacuum-sealed foundation is folded or rolled into its folded arrangement described above which may include the crosswise supports for a packaged foundation assembly, and the vacuum-sealed plastic membrane helps maintain the foam block in its compressed configuration. The packaging material surrounding the folded, compressed vacuum-sealed foundation and the shipping container also help to maintain this configuration for storage, shipment, and delivery. The compact size of the folded, compressed vacuum-sealed foundation is a significant improvement over known mattress foundations that cannot be compressed and folded to such a compact state. Additionally, the compact foundation can be inserted into a shipping container for storage, shipment, and delivery.

The use of a single-layer, internally-homogeneous, unitary foam block to produce the foundation is beneficial over multiple layers of foam that would cost more to manufacture and assemble. Multiple layer foam structures are typically used for foam mattresses where it is more important to support a person lying on the topside of the mattress while avoiding pressure points for the person or for providing extra support in particular areas, such as along the sides of the mattress, such as disclosed by U.S. Pat. Nos. 6,662,393, 6,901,722, and 9,259,099. Additionally, the absence of any internal elongated chamber, space, or other large void in the internally-homogeneous foam block is also beneficial for the foundation. Elongated chambers or other spaces or large voids within a foam mattress can be used for inserts allowing for a different firmness than the foam block or may have a bladder that can be filled with a fluid, such as disclosed by U.S. Pat. Nos. 6,061,856 and 9,655,456 (US Pat. App. Pub. No. 2015/0015402 by Boyd). In the particular instance of the '456 Patent which discloses a polyurethane foam body having a firmness IFD between eight and seventy pounds (8-70 pounds IFD), the voids with the fluid-filled bladders would be critical when using the firmer foams with an IFD above thirty-five (35) pounds for the mattress because such a firmer foam that is unitary and internally-homogeneous, i.e., without the voids and fluid-filled bladders, would not be suitable for use as a mattress due to the hardness of the material. However, different layers of foam and variations in firmness are not necessary or even desirable for a foundation which primarily functions to provide firm and even support to the underside of a mattress that is away from the person who is lying on the topside of the mattress. The uniform, firm support provided by the foundation to the underside of the mattress could be negatively impacted by using multiple layers of foam or by having chambers allowing for variations in the firmness, and the increased cost for the foundation would make it less desirable. Applicant also notes that it would necessarily change the principle of operation of foam mattresses with multiple layers or internal chambers and would render them less suitable for their intended purposes if these mattresses were to be changed to a single layer of foam and the internal chambers were not provided.

The use of crosswise supports at the bottom side of the foam foundation combined with the higher IFD of the foam used for the foundation provides sufficient rigidity to avoid sagging between adjacent crosswise supports that could negatively impact the uniformity of the support provided to the underside of the mattress. In German utility model application DE 20 2011 052 257 U1 by Lueck GmbH, a foam mattress has crosswise supports that are fit in channels in the foam block and are connected by flexible connectors, such as textile belts or straps. These straps would provide some additional support between the crosswise supports that may help prevent sagging of the mattress, but they also add complexity to the manufacture of the structure which will result in additional costs for production and the materials and will increase the weight of the mattress. The illustrations in the Lueck reference also show a dozen crosswise supports used in a closely-spaced arrangement, and applicant notes that twelve (12) crosswise supports for a standard length mattress would result in a spacing of approximately six and one half inches (6.5") between the centerlines of the crosswise supports, less than seven inches (7) when the two (2) end crosswise supports are positioned slightly inwardly from the head side and foot side of the mattress. Based on the illustration, the crosswise supports that have widths slightly smaller than the foam sections between the supports so it is apparent that the width of each crosswise support is approximately 3" and the distance between the crosswise supports is less than four inches (4"). Due to the lower IFD of the mattress foam in Lueck, it can be appreciated that the crosswise supports for the mattress are clearly more closely spaced than the expanded thickness of the foam mattress. In comparison, in the embodiments of the present invention for the foam foundation with crosswise supports situated in channels in the foam block, the crosswise supports are widely spaced with the distance between the crosswise supports being greater than the expanded thickness of the foam foundation.

The foundation is preferably produced using a single-layer of foam as explained above, and it will be appreciated that the foundation layer with the crosswise supports at the bottom side could be combined with one or more additional layers of foam attached to the top side of the foundation layer. Such an additional layer could have an IFD in a range that is more suitable for a mattress (i.e., between 8-20 pounds for memory foam blocks and between 15-35 pounds for latex foam blocks). In comparison to the mattress layer (s), the IFD for the foundation foam block is typically above 39 pounds as indicated above. Memory foam is not typically used for foundation foams because it is not necessary for the uniform, firm support of a mattress.

The embodiments of the foam foundation were chosen and described to best explain the principles of the invention and its practical application to persons who are skilled in the art. As various modifications could be made to the exemplary embodiments, as described above, without departing from the scope of the invention, it is intended that all matter contained in the foregoing description and shown in the accompanying drawings shall be interpreted as illustrative rather than limiting. For example, although the crosswise rigid supports are preferably lateral supports to allow for the most compact rolling of the foundation in the longitudinal direction around the lateral axis, it will be appreciated that longitudinal supports could also serve as the crosswise rigid supports, in which case the foundation would roll in the lateral direction around the longitudinal axis. Additionally, for bed frames that already have crosswise supports or have a platform or a web across the frame, the compact configuration of the foam in a cover could be packaged with instructions 100 in place of the crosswise supports that explain the seating of the foundation on spaced crosswise supports or other frame options to properly support the mattress. The crosswise supports provide crosswise rigidity, but they are not rigidly connected to each other and are only connected to each other through the foam material, or the foam and cover for the segmented foam foundation. The present invention has additional advantages over the traditional mattress foundation.

What is claimed is:

1. A foundation for supporting a mattress on a bed frame, comprising:

a foam block comprised of a top side, a bottom side, a head side, a foot side, a pair of side edges, a lateral width, and a longitudinal length, wherein the head side and the foot side are separated by the longitudinal length, wherein the pair of side edges are separated by the lateral width, wherein the foam block is further comprised of a flexible foam material having an internally-homogenous structure without any elongated chamber within the foam block and with an indentation force deflection greater than thirty-nine pounds and less than ninety-five pounds, wherein the foam block has a compressed configuration and an expanded configuration, wherein the top side and the bottom side are separated by a first thickness of the foam block in the compressed configuration and a second thickness of the foam block in the expanded configuration, and wherein the second thickness is greater than the first thickness;

a plurality of crosswise supports, wherein each one of the crosswise supports has a longitudinal dimension approximately equal to at least one of the lateral width and the longitudinal length of the foam block traversing at least one of an entire width of the foundation and an entire length of the foundation, respectively;

a cover enveloping the foam block;

a vacuum-seal plastic membrane encasing the foam block and the cover when the foam block is in the compressed configuration forming a packaged foundation, wherein the packaged foundation has an opened arrangement and a folded arrangement, wherein the foam block has a planar form in the opened arrangement, and wherein a center section of the foam block is overlapped in the folded arrangement either by the pair of side edges or by the head side and the foot side; and a shipping container having an interior space, wherein the packaged foundation in the folded arrangement fits in the interior space of the shipping container, and wherein the crosswise supports fit in the interior space of the shipping container with the packaged foundation.

2. The foundation of claim 1, wherein the foam block situated within the cover is comprised of a unitary, single layer of the flexible foam material without any fluid-filled bladder within the foam block.

3. The foundation of claim 1, wherein the crosswise supports are connected to the bottom side of the foam block, and wherein at least one pair of adjacent crosswise supports are spaced apart at a distance greater than the second thickness of the foam block in the expanded configuration and less than the lateral width of the foam block.

4. The foundation of claim 3, wherein the plurality of crosswise supports are only connected to each other through their connection to the foam block.

5. The foundation of claim 4, wherein the bottom side of the foam block is further comprised of a plurality of channels recessed into the foam block at spaced apart locations, wherein the channels extend either the entire lateral width of the foam block or the entire longitudinal length of the foam block and have a base between a pair of sidewalls and an open side at the bottom side of the foam block, wherein each one of the plurality of crosswise supports has a plurality of sides respectively contacting the sidewalls of the channels and an outer-facing side not in contact with the sidewalls, wherein the outer-facing side of the plurality of crosswise supports is substantially flush with a surface of the bottom side of the foam block, and wherein each one of the crosswise supports has a width less than the second thickness of the foam block in the expanded configuration.

6. The foundation of claim 4, wherein each one of the crosswise supports has a width greater than the second thickness of the foam block in the expanded configuration and is attached directly to a surface of the bottom side of the foam block.

7. The foundation of claim 6, wherein a total surface area of the crosswise supports in contact with the foam block is greater than one half an entire surface area of the bottom side of the foam block and is less than the entire surface area.

8. The foundation of claim 6, wherein the foam block is further comprised of at least three foam sections, wherein each pair of adjacent foam sections is connected by a hinged section of the cover, and wherein the hinged section of the cover alternates between a first location at the top side of the foam block for a first pair of adjacent foam sections and a second location at the bottom side of the foam block for a second pair of adjacent foam sections.

9. The foundation of claim 1, wherein the crosswise supports are not attached to the foam block within the interior space of the shipping container.

10. The foundation of claim 9, wherein the crosswise supports are separated from the foam block and are outside of the cover.

11. A foundation for supporting a mattress on a bed frame, comprising:

a foam block comprised of a top side, a bottom side, a head side, a foot side, a pair of side edges, a lateral width, and a longitudinal length, wherein the head side and the foot side are separated by the longitudinal length, wherein the pair of side edges are separated by the lateral width, wherein the foam block is further comprised of a flexible foam material having an indentation force deflection greater than thirty-nine pounds and less than ninety-five pounds, wherein the foam block has a compressed configuration and an expanded configuration, wherein the top side and the bottom side are separated by a first thickness of the foam block in the compressed configuration and a second thickness of the foam block in the expanded configuration, and wherein the second thickness is greater than the first thickness;

a plurality of crosswise supports connected to the bottom side of the foam block, wherein each one of the crosswise supports has a longitudinal dimension approximately equal to at least one of the lateral width and the longitudinal length of the foam block, wherein each one of the crosswise supports has a thickness less than the first thickness of the foam block in the compressed configuration, and wherein no rigid connection extends between the adjacent pairs of the crosswise supports;

a cover enveloping the foam block and the crosswise supports; and a vacuum-seal plastic membrane encasing the foam block, the crosswise supports, and the cover when the foam block is in the compressed configuration forming a packaged foundation assembly.

12. The foundation of claim 11, wherein the foam block is comprised of an internally-homogenous structure without any elongated chamber within the foam block, and wherein the plurality of crosswise supports are only connected to each other through their connection to the foam block.

13. The foundation of claim 11, wherein at least one pair of adjacent crosswise supports are spaced apart at a distance greater than the second thickness of the foam block in the expanded configuration and less than the lateral width of the foam block.

14. The foundation of claim 11, wherein the foam block is further comprised of at least three foam sections, wherein each pair of adjacent foam sections is connected by a hinged section of the cover, and wherein the hinged section of the cover alternates between a first location at the top side of the foam block for a first pair of adjacent foam sections and a second location at the bottom side of the foam block for a second pair of adjacent foam sections.

15. The foundation of claim 11, further comprising a shipping container having an interior space, wherein the packaged foundation assembly in a folded arrangement fits in the interior space of the shipping container.

16. A foundation for supporting a mattress on a bed frame, comprising:

a foam block comprised of a top side, a bottom side, a head side, a foot side, a pair of side edges, a lateral width, and a longitudinal length, wherein the head side and the foot side are separated by the longitudinal length, wherein the pair of side edges are separated by the lateral width, wherein the foam block is further comprised of a flexible foam material, wherein the foam block has a compressed configuration and an expanded configuration, wherein the top side and the bottom side are separated by a first thickness of the foam block in the compressed configuration and a second thickness of the foam block in the expanded configuration, and wherein the second thickness is greater than the first thickness;

a plurality of crosswise supports connected to the bottom side of the foam block, wherein each one of the crosswise supports has a longitudinal dimension approximately equal to at least one of the lateral width and the longitudinal length of the foam block, and wherein the plurality of crosswise supports are only connected to each other through their connection to the foam block;

a cover enveloping the foam block and the crosswise supports; and a vacuum-seal plastic membrane encasing the foam block, the crosswise supports, and the cover when the foam block is in the compressed configuration forming a packaged foundation assembly.

17. The foundation of claim 16, wherein at least one pair of adjacent crosswise supports are spaced apart at a distance greater than the second thickness of the foam block in the expanded configuration and less than the lateral width of the foam block.

18. The foundation of claim 16, wherein the foam block is comprised of an internally-homogenous foam structure without any elongated chamber within the foam block and with an indentation force deflection greater than thirty-nine pounds and less than ninety-five pounds.

19. The foundation of claim 17, wherein the foam block is further comprised of at least three foam sections, wherein each pair of adjacent foam sections is connected by a hinged section of the cover, and wherein the hinged section of the cover alternates between a first location at the top side of the foam block for a first pair of adjacent foam sections and a second location at the bottom side of the foam block for a second pair of adjacent foam sections.

20. The foundation of claim 16, further comprising a shipping container having an interior space, wherein the packaged foundation assembly in a folded arrangement fits in the interior space of the shipping container.

* * * * *